US012618291B2

(12) United States Patent
Khapochkin

(10) Patent No.: US 12,618,291 B2
(45) **Date of Patent: *May 5, 2026**

(54) PITCH DATA PROCESSING SYSTEM FOR HORIZONTAL DIRECTIONAL DRILLING

(71) Applicant: Underground Magnetics, Inc., Johnston, IA (US)

(72) Inventor: Yuriy Khapochkin, Johnston, IA (US)

(73) Assignee: Underground Magnetics, Inc., Johnston, IA (US)

( * ) Notice: Subject to any disclaimer, the term of this patent is extended or adjusted under 35 U.S.C. 154(b) by 66 days.

This patent is subject to a terminal disclaimer.

(21) Appl. No.: 18/631,777

(22) Filed: Apr. 10, 2024

(65) Prior Publication Data

US 2024/0344400 A1 Oct. 17, 2024

Related U.S. Application Data

(63) Continuation of application No. 17/148,997, filed on Jan. 14, 2021, now Pat. No. 11,976,555.
(Continued)

(51) Int. Cl.
*E21B 47/024* (2006.01)
*E21B 7/04* (2006.01)
(Continued)

(52) U.S. Cl.
CPC ..... *E21B 7/046* (2013.01); *E21B 43/305* (2013.01); *E21B 47/02* (2013.01); *E21B 47/024* (2013.01)

(58) Field of Classification Search
None
See application file for complete search history.

(56) References Cited

U.S. PATENT DOCUMENTS 4,164,871 A 8/1979 Cole et al.
4,646,277 A 2/1987 Bridges et al.
(Continued)

FOREIGN PATENT DOCUMENTS

EP 0846841 A2 6/1998
EP 0846841 B1 4/2004
GB 2175096 A 11/1986

OTHER PUBLICATIONS

International Search Report and Written Opinion for Application No. PCT/US2021/013386, dated Apr. 28, 2021.

*Primary Examiner* — Tara Schimpf
*Assistant Examiner* — Ursula Lee Norris
(74) *Attorney, Agent, or Firm* — Erik M. Antonson; Advent, LLP

(57) ABSTRACT

A pitch data processing system of a horizontal directional drilling system can include a sonde, an offset and range calibration unit, a pitch speed limiter, and a low pass filter. The sonde can include an accelerometer configured to measure and output a raw pitch signal. The offset and range calibration unit can receive and process the raw pitch signal and output a calibrated pitch signal. The pitch speed limiter can receive the calibrated pitch signal. The pitch speed limiter is configured to set upper and lower pitch change speed limits. The pitch speed limiter can yield a speed-change limited pitch signal. The low pass filter can receive the speed-change limited pitch signal and attenuate the received speed-change limited pitch signal above a selected cutoff frequency of the low pass filter, the low pass filter configured to output an adjusted pitch signal.

20 Claims, 7 Drawing Sheets

Related U.S. Application Data

(60) Provisional application No. 62/960,833, filed on Jan. 14, 2020.

(51) Int. Cl.
*E21B 43/30* (2006.01)
*E21B 47/02* (2006.01)

(56) References Cited

U.S. PATENT DOCUMENTS 4,804,051 A 2/1989 Ho
4,881,083 A 11/1989 Chau et al.
5,165,490 A 11/1992 Nosaka
5,363,926 A 11/1994 Mizuno
5,425,179 A 6/1995 Nickel et al.
5,469,155 A 11/1995 Archambeault et al.
5,703,484 A 12/1997 Bieberdorf et al.
5,711,381 A 1/1998 Archambeault et al.
5,767,678 A * 6/1998 Mercer ..... G01V 3/165 175/45
5,850,624 A 12/1998 Gard et al.
5,880,680 A * 3/1999 Wisehart ..... E21B 47/024 175/26
6,008,651 A 12/1999 Mercer
6,202,012 B1 3/2001 Gile et al.
6,232,780 B1 5/2001 Mercer
6,315,062 B1 11/2001 Alft et al.
6,470,976 B2 10/2002 Alft et al.
7,251,567 B2 * 7/2007 Nickel ..... G01C 17/00 702/9
7,607,494 B2 10/2009 Alft et al.
7,975,392 B1 * 7/2011 Spaulding ..... E21B 47/022 33/313
9,158,024 B2 10/2015 Överby et al.
9,664,027 B2 * 5/2017 Chau ..... E21B 47/02
10,227,867 B2 * 3/2019 Chau ..... E21B 7/046
2003/0056983 A1 3/2003 Alft et al.
2003/0063013 A1 4/2003 Jin et al.
2003/0197509 A1 10/2003 Mizuno
2007/0240903 A1 10/2007 Alft et al.
2007/0256863 A1 11/2007 Hulick et al.
2010/0139982 A1 6/2010 Carlson et al.
2010/0141261 A1 6/2010 Overby et al.
2011/0245980 A1 10/2011 Nessjoen et al.
2012/0232800 A1 9/2012 Overby et al.
2013/0000980 A1 1/2013 Dolgin et al.
2014/0102792 A1 4/2014 Lachner, Jr. et al.
2015/0345222 A1 12/2015 Elshafei et al.
2017/0234120 A1 8/2017 Chau et al.
2019/0169979 A1 6/2019 Nguyen et al.
2021/0215000 A1 7/2021 Khapochkin

* cited by examiner

PITCH DATA PROCESSING SYSTEM FOR HORIZONTAL DIRECTIONAL DRILLING

CROSS-REFERENCE TO RELATED APPLICATIONS

The present application is a continuation under 35 U.S.C. § 120 of U.S. patent application Ser. No. 17/148,997, filed Jan. 14, 2021, and titled "PITCH DATA PROCESSING SYSTEM FOR HORIZONTAL DIRECTIONAL DRILLING," which claims priority under 35 U.S.C. § 119(e) of U.S. Provisional Application Ser. No. 62/960,833, filed Jan. 14, 2020, and titled "ACCOMMODATING PITCH INSTABILITY IN HORIZONTAL DIRECTIONAL DRILLING." U.S. patent application Ser. No. 17/148,997 and U.S. Provisional Application Ser. No. 62/960,833 are herein incorporated by reference in their entireties.

BACKGROUND

Utility lines for water, electricity, gas, telephone, and cable television are often run underground for reasons of safety and aesthetics. In many situations, the underground utilities can be buried in a trench which is then back-filled. Although useful in areas of new construction, the burial of utilities in a trench has certain disadvantages. In areas supporting existing construction, a trench can cause serious disturbance to structures or roadways. Further, there is a high probability that digging a trench may damage previously buried utilities, and that structures or roadways disturbed by digging the trench are rarely restored to their original condition. Also, an open trench may pose a danger of injury to workers and passersby.

The general technique of boring a horizontal underground hole has recently been developed in order to overcome the disadvantages described above, as well as others unaddressed when employing conventional trenching techniques. In accordance with such a general horizontal boring technique, also known as horizontal directional drilling (HDD) or trenchless underground boring, a boring system is situated on the ground surface and drills a hole into the ground at an oblique angle with respect to the ground surface. A drilling fluid is typically flowed through the drill string, over the boring tool, and back up the borehole in order to remove cuttings and dirt. After the boring tool reaches a desired depth, the tool is then directed along a substantially horizontal path to create a horizontal borehole. After the desired length of borehole has been obtained, the tool is then directed upwards to break through to the earth's surface. A reamer is then attached to the drill string which is pulled back through the borehole, thus reaming out the borehole to a larger diameter. It is common to attach a utility line or other conduit to the reaming tool so that it is dragged through the borehole along with the reamer.

Another technique associated with horizontal directional drilling, often referred to as push reaming, involves attaching a reamer to the drill string at the entry side of a borehole after the boring tool has exited at the exit side of the borehole. The reamer is then pushed through the borehole while the drill rods being advanced out of the exit side of the borehole are individually disconnected at the exit location of the borehole. A push reaming technique is sometimes used because it advantageously provides for the recycling of the drilling fluid. The level of direct operator interaction with the drill string, such as is required to disconnect drill rods at the exit location of the borehole, is much greater than that associated with traditional horizontal directional drilling techniques.

The process of horizontal directional drilling has undergone significant development over the past two decades. These developments have involved the drilling machines and the location detection and directional control components. Several types of location detection and directional control systems have been utilized, with today's walk-over guidance systems becoming the most accepted technology. As the guidance/locator technology is quite different than the mechanical technology utilized in developing the drilling machines, in most instances companies have developed either the drilling machine or the guidance systems, but typically not both. As a result, there are now several suppliers of walk-over guidance systems, each with unique features, that are used with the variety of drilling machines.

Early in the development of horizontal directional drilling technology, it was recognized that there was a potential to incorporate location information, as generated from a remote electronic component and transferred via radio signals or hard wire, into the control of the drilling machines. Examples of this include U.S. Pat. Nos. 4,646,277 and 4,881,083, and GB 2175096, which are hereby incorporated herein by reference in their respective entireties. These systems were primarily configured as bore-to-target systems where the remote electronic component was placed at a position near a destination point. This remote electronic component then cooperated with the drilling machine, and specifically with an electronic component mounted in the drill head, with each individual component integral to the control system.

These systems provided varying degrees of success in directing a cutting tool to a target point but did not provide accurate continuous information about the location of the cutting tool. Close monitoring of the cutting tool's location as it passes near to various underground objects at all points of the bore is generally considered critical to the overall process. Thus, the systems that operated in a manner to guide the cutting tool to a target turned out to be less useful than systems wherein cutting tool location was continuously monitored. These systems, referred to today as walk-over guidance systems, have been developed to provide a continuous or quasi-continuous monitoring capability. Several patents have been issued disclosing various aspects of the locating systems of the walk-over guidance systems, including U.S. Pat. Nos. 6,232,780; 6,008,651; 5,767,678; 5,880,680; 5,703,484; 5,425,179; 5,850,624; 5,711,381; 5,469,155; 5,363,926; and 5,165,490, which are hereby incorporated herein by reference in their respective entireties.

Other technologies are capable of providing information about travel of the drill head, including the use of gyroscopes, accelerometers, magnetometers, etc., in various types of dead-reckoning techniques or other techniques including establishing an electromagnetic field to be sensed by the drill head's electronics. Data from such sensors is typically transferred by what is known as a wire line, where an actual wire conductor extends within the drill pipe from the drilling bit back to the drilling machine, or by a wireless connection (e.g., Bluetooth wireless technology implementing short-wavelength UHF radio waves).

DRAWINGS

The Detailed Description is described with reference to the accompanying figures.

DETAILED DESCRIPTION

Figure 1:
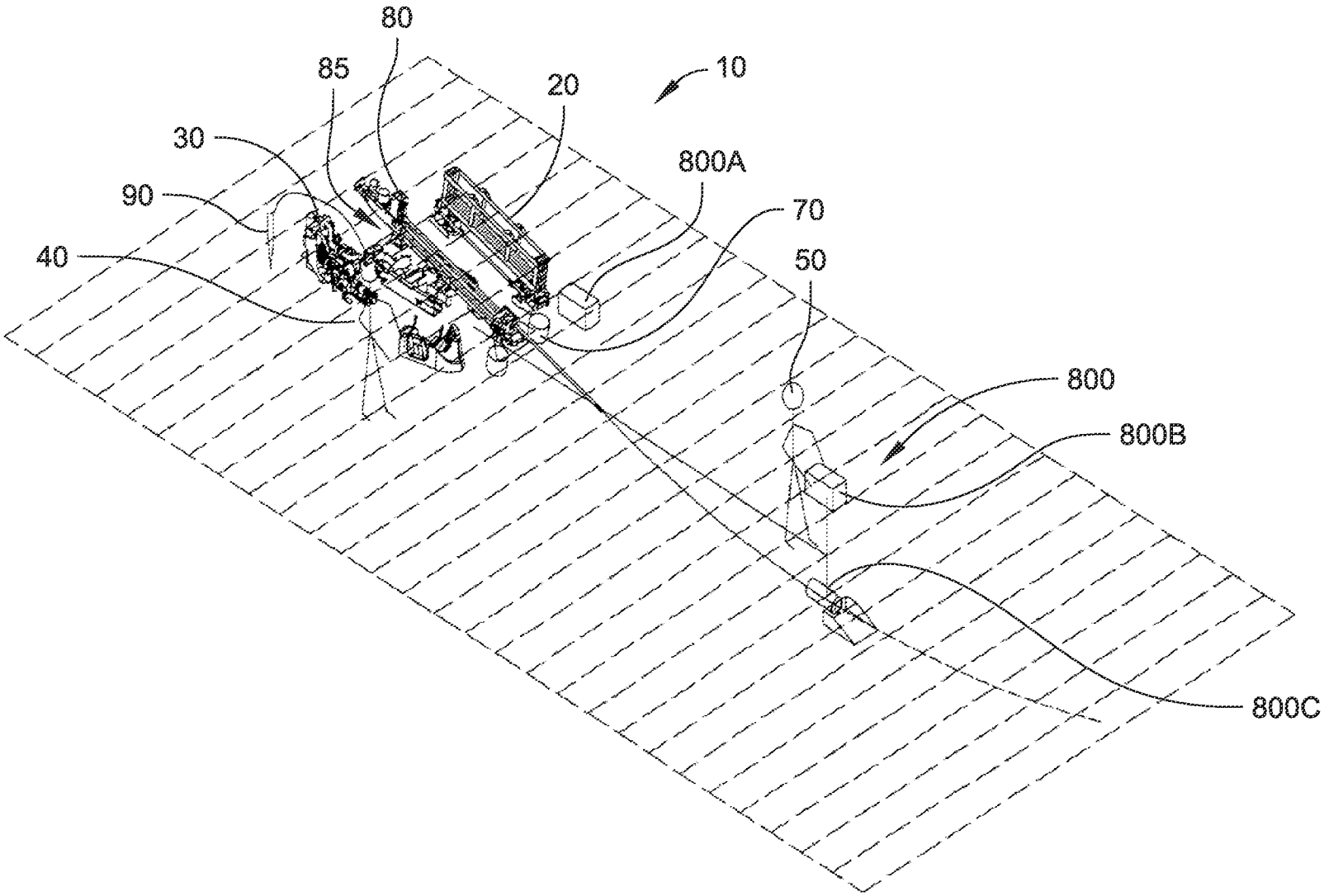
FIG. 1 is an isometric, schematic view of a horizontal drilling system, the drilling system incorporating a component interface architecture, in accordance with an embodiment of the present disclosure.

Aspects of the disclosure are described more fully hereinafter with reference to the accompanying drawings, which form a part hereof, and which show, by way of illustration, example features. The features can, however, be embodied in many different forms and should not be construed as limited to the combinations set forth herein; rather, these combinations are provided so that this disclosure will be thorough and complete, and will fully convey the scope.

Overview

In the profession of locating for horizontal directional drilling, pitch can be a crucial piece of data for operators to steer the drill head. Pitch can be calculated in the transmitter based on readings from an accelerometer. This calculation assumes that the transmitter has no external forces acting on it. However, while drilling, the lack of external forces (e.g., such as those caused by hitting a rock or other hard object) cannot be assumed. When moving and hitting a hard object, the acceleration from the impact may not be distinguishable from that of the position change. This sudden change in acceleration can create an erratic reading. If the pitch is not processed to account for such anomalies, the pitch readout may be unusable, as it may jump all over the place. Using a low pass filter, it is possible to ignore short spikes that would otherwise appear in a readout. However, this standard process does not always work well for all situations, resulting in instability in the displayed pitch. This instability can lead to a decrease in accuracy and/or productivity and, in some instances, may impact the safety of the drilling process.

The present system can offer an operator an option on pitch calculations, based on the type of job being performed and/or the type of drill used. For example, larger jobs on big machines can require high stability and accuracy, as larger housings and rods do not allow for quick changes in pitch. Conversely, smaller jobs/machines can require faster reactions to pitch changes and can tolerate more instability. In an embodiment, the initial pitch signal processing for the pitch data can be generated by the transmitter (e.g., associated with the sonde) and be communicated (e.g., via Bluetooth transmission or another wireless connection) from the transmitter to an above-ground receiver.

Since drilling is done exclusively underground, there are physical limitations to how fast pitch can change. Extremely quick changes seen in the acceleration and thus pitch are thus essentially "noise." If such a reading were truly accurate, the result would likely be a broken drill rod. Thus, the present system can generate an upper and lower limit of an allowed speed of pitch change to be read out (e.g., to a display or print out) from the previous measurement. Anything above or below the limit can be brought within the set limits. These limits can be chosen by the user prior to starting the job, for example via the Bluetooth connection between the transmitter and receiver.

The present system can permit the user to select a pitch change speed working range for a horizontal directional drilling operation and, possibly, the pitch change speed limitation based on the rotation/push condition.

Example Implementations

FIG. 1 illustrates an overall horizontal directional drilling (HDD) system 10, in accordance with an embodiment of the present disclosure. The major components can include a drilling machine 80, a mud system 30, and a walk-over guidance system 800. The drilling machine 80 can include a power system 85, pipe handling system 20, stake down system 70, and strike alert system 90. The walk-over guidance system 800 can include an RF (i.e., radio frequency) unit 800*a* mounted on the drilling machine 80, a locator 800*b* (e.g., an above-ground walk-over locator unit), and a sonde 800*c* (e.g., carried by the drill (not labelled) of the drilling machine 80). As discussed below, the RF unit 800*a* and/or sonde 800*c* can be considered part of, or excluded as part of, the walk-over guidance system 800 provided by a given walk-over system manufacturer. Potential operators include a drilling machine operator 40 and a locator operator 50.

Figure 2:
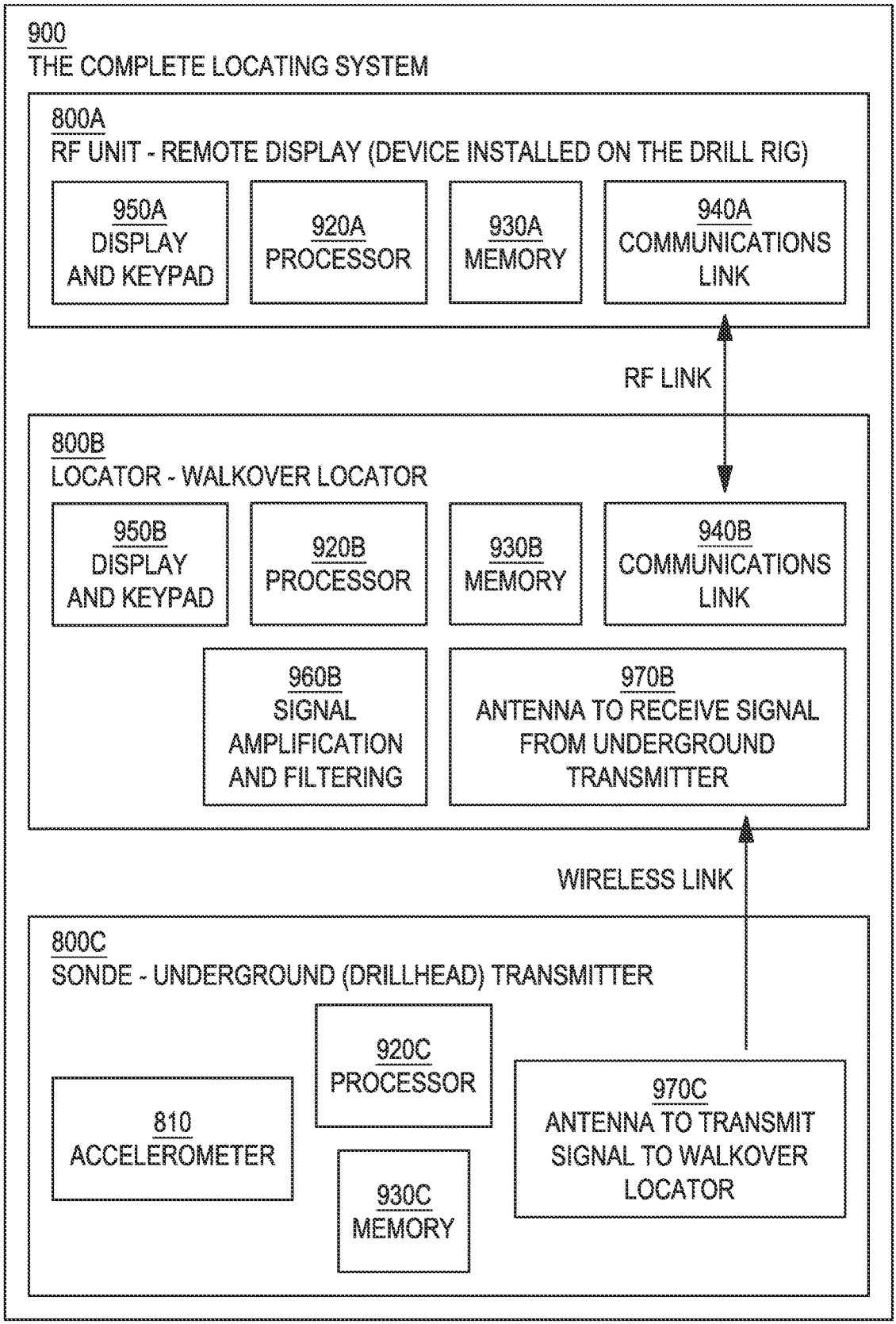
FIG. 2 is a schematic view of a walk-over locator system associated with the horizontal drilling system shown in FIG. 1.

FIG. 2 illustrates a block diagram of the walkover control and display system 900 (e.g., the locating system 900) for the walk-over guidance system 800 of the drilling machine 80 of the type depicted in FIG. 1. The walkover control and display system 900, as stated above, can include a RF unit 800A (e.g., a remote unit with a display installed on the drill rig 80), a locator 800B (e.g., the walk-over locator), and a sonde 800C. The RF unit 800C can include a processor 920A, a memory 930A, a communication or data link or interface 940A (e.g., abbreviated as "comm link" in FIG. 2), and at least one input/output unit 950A (e.g., a display and keyboard, as shown). In an embodiment, the RF unit 800C can be an RF-enabled controller. In an embodiment, the communication link 940C may be enabled for RF communication.

The locator 800B can include a processor 920B, a memory 930B, a communication or data link or interface 940B (e.g., abbreviated as "comm link" in FIG. 2), at least one input/output unit 950B (e.g., a display and keyboard, as shown), a signal amplification and filtering unit 960B, and an antenna 970B. The sonde 800C can include one or more motion sensors, such as one or more accelerometers 810, for measuring one or more of the pitch, yaw, or roll of the sonde 800*c*, of which the measurement and display of the pitch of the walkover control and display system 900 will be discussed more in detail later. The sonde 800C can further include a processor 920C, a memory 930C, and an antenna 970C (e.g., such a combination of components for processing, saving, and/or transmitting the signals generated by the one or more motion sensors). The antenna 970C can transmit a signal to the walkover locator 800B, and the antenna 970B can receive the signal from the underground transmitter (e.g., via the underground antenna 970C). In an embodiment, the signal between antennas 970B, 970C may be communicated via a Bluetooth or another short-range wireless communication mechanism.

The components of the walkover control and display system 900, along with any other elements of the horizontal directional drilling system 10 capable of being electrically or electronically linked, can be communicatively connected (e.g., via wired or wireless communication), at least in part, to automatically facilitate the operations discussed above. The walkover control and display system 900 may further be in communication with one or more system inputs (e.g., touchscreen, keypad, keyboard, joystick, etc.) and/or one or more system outputs (e.g., visual display or audio or visual signal). Such system inputs and/or outputs can be associated with any of the drilling machine 80, the mud system 30, or the walk-over guidance system 800.

In embodiments, a given processor 920A, 920B, 920C provides processing functionality for a corresponding unit 800A, 800B, 800C and can include any number of processors, micro-controllers, circuitry, field programmable gate array (FPGA) or other processing systems, and resident or external memory for storing data, executable code, and other information accessed or generated by the given unit 800A, 800B, 800C. The processor 920A, 920B, 920C can execute one or more software programs embodied in a non-transitory computer readable medium that implement techniques described herein. The processor 920A, 920B, 920C is not limited by the materials from which it is formed or the processing mechanisms employed therein and, as such, can be implemented via semiconductor(s) and/or transistors (e.g., using electronic integrated circuit (IC) components), and so forth.

The memory 930A, 930B, 930C can be an example of tangible, computer-readable storage medium that provides storage functionality to store various data and or program code associated with operation of the given unit 800A, 800B, 800C, such as software programs and/or code segments, or other data to instruct the processor 920A, 920B, 920C, and possibly other components of the walkover control and display system 900 and/or the overall horizontal directional drilling system 10, to perform the functionality described herein. Thus, the memory 930A, 930B, 930C can store data, such as a program of instructions for operating the system 900 (including its components), the horizontal directional drilling system 10, and so forth. It should be noted that while a single memory is described, a wide variety of types and combinations of memory (e.g., tangible, non-transitory memory) can be employed. The memory 930A, 930B, 930C can be integral with the respective processor 920A, 920B, 920C, can comprise stand-alone memory, or can be a combination of both.

Some examples of the memory can include removable and non-removable memory components, such as random-access memory (RAM), read-only memory (ROM), flash memory (e.g., a secure digital (SD) memory card, a mini-SD memory card, and/or a micro-SD memory card), magnetic memory, optical memory, universal serial bus (USB) memory devices, hard disk memory, external memory, remove (e.g., server and/or cloud) memory, and so forth. In implementations, the memory 930A, 930B, 930C can include removable integrated circuit card (ICC) memory, such as memory provided by a subscriber identity module (SIM) card, a universal subscriber identity module (USIM) card, a universal integrated circuit card (UICC), and so on.

The communications link or interface 940A, 940B can be operatively configured to communicate with components of the overall directional drilling system 10 and/or the walkover control and display system 900. For example, the communications interface can be configured to transmit and/or receive data for storage by the system 10, 900, and so forth. The communications interface 940A, 940B can also be communicatively coupled with a corresponding processor 920A, 920B to facilitate data transfer between components of the system 10, 900 and the given processor 920A, 920B. It should be noted that while the communications interface is described as a component of controller, one or more components of the communications interface can be implemented as external components communicatively coupled to the system 10, 900 or components thereof via a wired and/or wireless connection. The system 100, 300 or components thereof can also include and/or connect to one or more input/output (I/O) devices (e.g., via the communications interface), such as a display and keyboard 950, a stand-alone display, a stand-alone keyboard, a mouse, a touchpad, a joystick, a touchscreen, a keyboard, a microphone (e.g., for voice commands) and so on.

The communications interface 940A, 940B and/or the processor 920A, 920B, 920C can be configured to communicate with a variety of different networks, such as a wide-area cellular telephone network, such as a cellular network, a 3G cellular network, a 4G cellular network, a 5G cellular network, or a global system for mobile communications (GSM) network; a wireless computer communications network, such as a WiFi network (e.g., a wireless local area network (WLAN) operated using IEEE 802.11 network standards); an ad-hoc wireless network, an internet; the Internet; a wide area network (WAN); a local area network (LAN); a personal area network (PAN) (e.g., a wireless personal area network (WPAN) operated using IEEE 802.15 network standards); a public telephone network; an extranet; an intranet; and so on. However, this list is provided by way of example only and is not meant to limit the present disclosure. Further, the communications interface 940A, 940B can be configured to communicate with a single network or multiple networks across different access points. In a specific embodiment, a communications interface can transmit information from the controller to an external device (e.g., a cell phone, a computer connected to a WiFi network, cloud storage, etc.). In another specific embodiment, a communications interface can receive information from an external device (e.g., a cell phone, a computer connected to a WiFi network, cloud storage, etc.).

Communication between the components of the overall horizontal directional drilling system 10 and/or the walkover control and display system 900 can utilize any number of data linking techniques. Examples of such techniques include those disclosed in U.S. Pat. No. 6,202,012, which is hereby incorporated herein by reference in its entirety. In an embodiment, the data link between the elements is implemented to comply with an industry standard known as CAN. CAN is based on an ISO standard (ISO 11898) for serial data communication.

Figure 3:
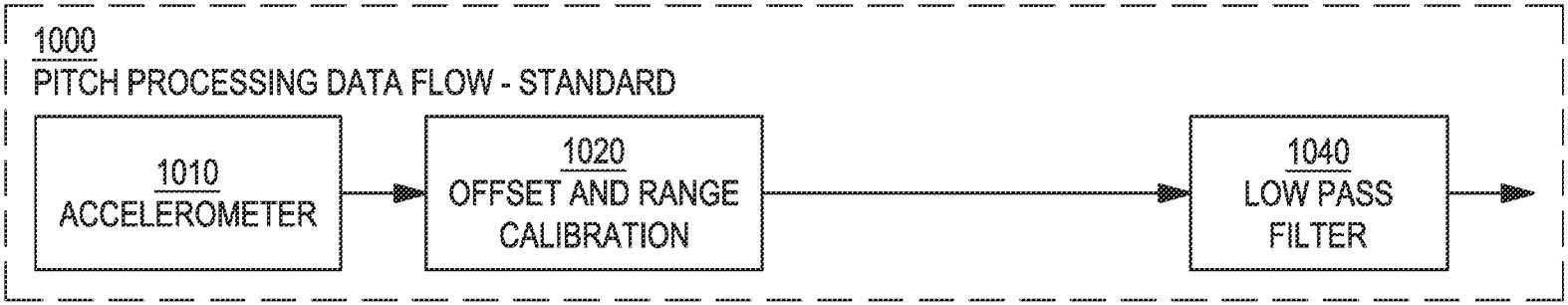
FIG. 3 is a schematic view of a standard pitch processing system associated with a horizontal drilling system.

FIG. 3 illustrates a standard pitch processing system 1000 for use with a horizontal drilling system (e.g., horizontal directional drilling system 10). The standard pitch processing system 1000 can include an accelerometer 1010 (e.g., located at the sonde 800*c*), an offset and range calibration unit 1020 (e.g., calibration hardware and/or software), and a low pass filter 1040. A signal generated by the accelerometer 1010 can pass to the offset and range calibration unit 1020 and then through the low pass filter 1040, resulting in refined pitch data suitable for output to a display (e.g., displayed as percent pitch change versus time) and/or use in operational decisions (e.g., by user or system controllers). In an embodiment, the offset and range calibration unit 1020 and the low pass filter 1040 may be incorporated into either the signal amplification and filtering unit 960B or sonde 800C. In an embodiment, the low pass filter 1040 is a signal filter that passes signals with a lower frequency than a selected cutoff frequency and attenuates signals with frequencies higher than the cutoff frequency.

Figure 4:
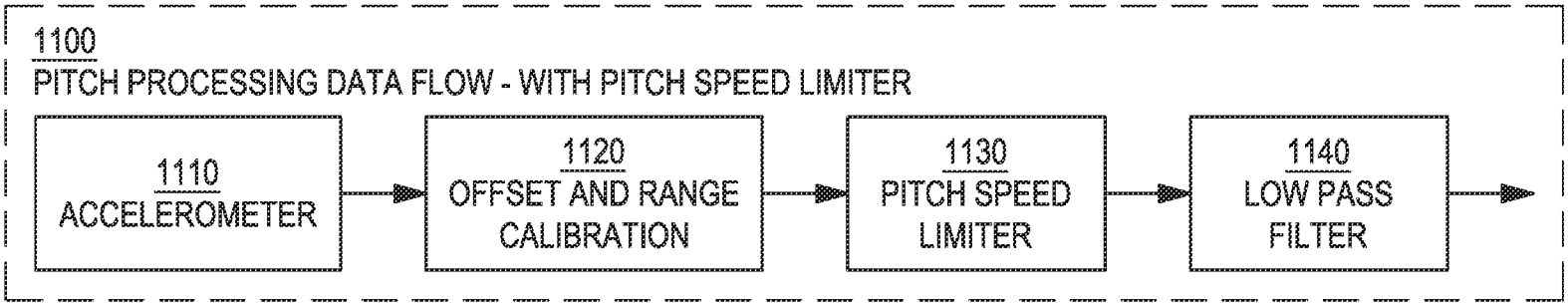
FIG. 4 is a schematic view of an embodiment of a pitch processing data flow system of a horizontal drilling system, incorporating a pitch speed limiter, in accordance with an embodiment of the present disclosure.

FIG. 4 illustrates a pitch processing system 1100 for use with a horizontal drilling system (e.g., horizontal directional drilling system 10), in accordance with an example embodiment of the present disclosure. The pitch processing system 1100 can include an accelerometer 1110 (e.g., located at the sonde 800*c*), an offset and range calibration unit 1120 (e.g., programable calibration hardware and/or software), a pitch speed limiter 1130, and a low pass filter 1140, in electronic communication (e.g., wired or wireless) or otherwise communicatively coupled with one another. In an embodiment, a signal generated by the accelerometer 1110 can pass to the offset and range calibration unit 1120 and then through the pitch speed limiter 1130 and the low pass filter 1140, resulting in an adjusted output for the pitch (e.g., displayed as percent pitch change). In an embodiment, the offset and range calibration unit 1120 can receive and process the raw pitch signal (e.g., from the accelerometer/sonde) and output a calibrated pitch signal. In an embodiment, the low pass filter 1140 can receive the speed-change limited pitch signal and attenuate the received speed-change limited pitch signal above a selected cutoff frequency of the low pass filter 1140.

In an embodiment, the offset and range calibration unit 1120, the pitch speed limiter 1130, and the low pass filter 1140 are located above ground (e.g., in the locator 800B, with the "raw" accelerometer signal sent above ground via a Bluetooth or other wireless communication). In an embodiment, the offset and range calibration unit 1120 (e.g., calibration hardware and/or software), the pitch speed limiter 1130, and the low pass filter 1140 may be incorporated into the signal amplification and filtering unit 960B, as part of the walk-over locator 800B. In another embodiment, the offset and range calibration unit 1120, the pitch speed limiter 1130, and the low pass filter 1140 can be located in the sonde 800*c*, with the resulting pitch output sent, for example, to an above-ground display (e.g., 950A, 950B).

The pitch speed limiter 1130 can be in the form of software and/or a processing unit (e.g., hardware). The pitch speed limiter 1130 can set an upper pitch change speed limit and a lower pitch change speed limit, thereby creating an allowable window or range of pitch change speed. The signal transmitter in the form of the pitch speed limiter 1130 can dictate that the next pitch reading displayed to the user is to be within the window (i.e., set range) of the previous pitch measurement. If the measurement is outside the window, it can be adjusted to be inside thereof. Such pitch adjustments instituted by the pitch speed limiter 1130 can result in more stable pitch readings over a course of a job. The adjusted pitch data can, for example, be output to a display 950 (e.g., display to a system user) and/or used by the processor 920 (e.g., used for controlling operation of the HDD system).

In an embodiment, the pitch change speed limit can be based on the type of job being performed (e.g., diameter of component delivered by the HDD system) and/or the type of drill used. In an embodiment, the pitch change speed limit (e.g., pitch change speed range) may be defined in terms of a maximum pitch change speed between the upper pitch change speed limit and the lower pitch change speed limit. For example, larger jobs on big machines require high stability and accuracy, as larger housings and rods generally do not allow for quick changes in pitch, typically dictating a tighter pitch change speed range (e.g., a pitch change speed range of 2-5%/second (sec) for larger drills; or a pitch change speed range of 1%/sec for the largest drills and/or stricter requirements (for example, sewer pipes)). Conversely, smaller jobs/machines usually require faster reactions to pitch changes and can tolerate more instability, permitting a broader pitch change speed range (e.g., a pitch change speed range of 5-10%/sec). In an embodiment, the user may select the pitch change speed range to be implemented. In an embodiment, the user can select the pitch change speed range using the locator 800B, the RF unit 800A, or another above-ground wireless device to communicate the desired pitch change parameters to the sonde 800C.

Figure 5:
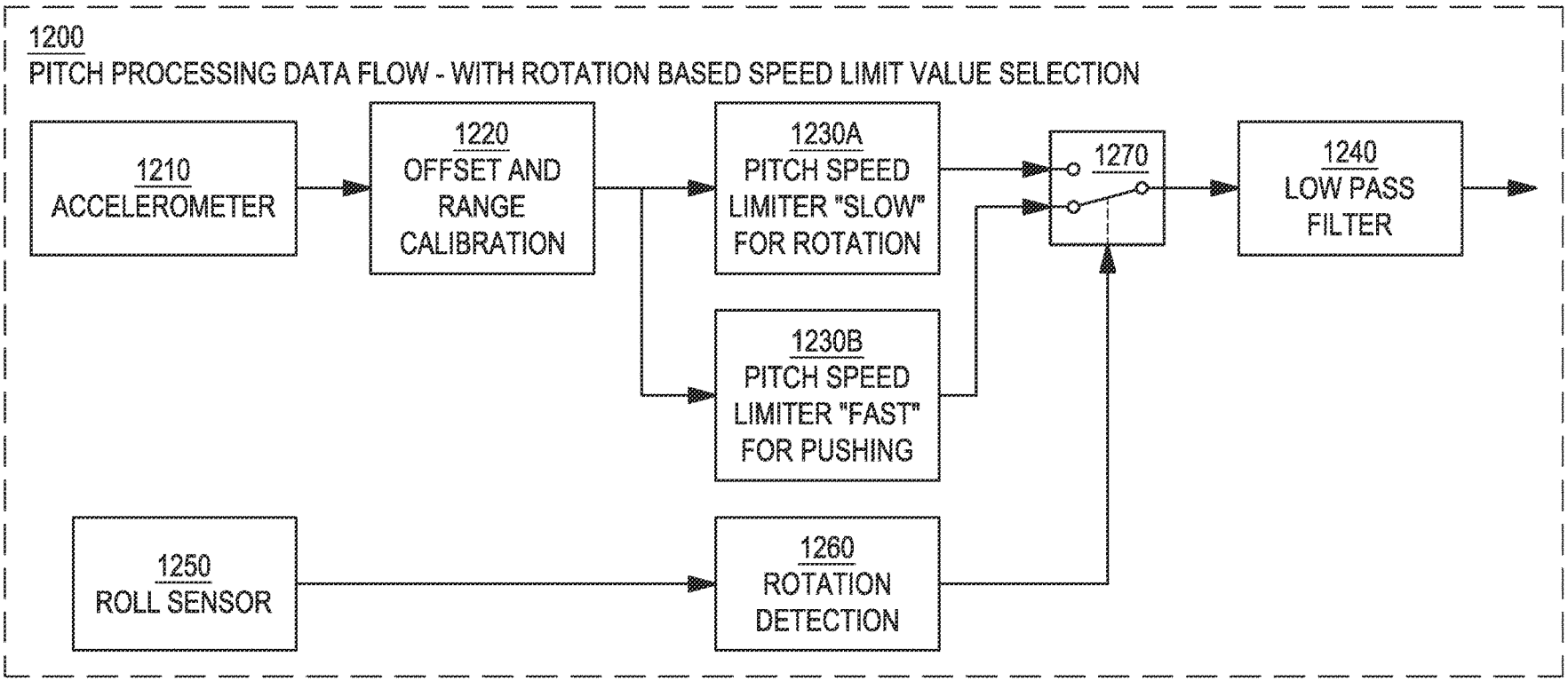
FIG. 5 is a schematic view of an embodiment of a pitch processing data flow system of a horizontal drilling system, with a rotation-based speed limit value selection, in accordance with an embodiment of the present disclosure.

FIG. 5 illustrates a pitch processing system 1200 for use with a horizontal drilling system (e.g., horizontal directional drilling system 10), in accordance with an example embodiment of the present disclosure. The pitch processing system 1200 is similar in function and components as the pitch processing system 1100, except as discussed as below. Thus, similarly numbered parts (e.g., accelerometer 1110 and 1210) can be expected to be constructed and to function in a similar manner. The pitch processing system 1200 can include an accelerometer 1210 (e.g., located at the sonde 800*c*), an offset and range calibration unit 1220 (e.g., programable calibration hardware and/or software), a "slow" pitch speed limiter 1230A, a "fast" pitch speed limiter 1230B, and a low pass filter 1240; and a roll sensor 1250 (i.e., incorporated in the sonde 800C) and a rotation detection unit 1260 (e.g., in the form of software and/or a programable detection unit), in electronic communication (e.g., wired or wireless) with one another. In an embodiment, the offset and range calibration unit 1220 (e.g., calibration hardware and/or software), the "slow" pitch speed limiter 1230A, the "fast" pitch speed limiter 1230B, and the low pass filter 1240 may be incorporated into the signal amplification and filtering unit 960B.

The pitch processing system 1200 can permit rotation-based speed limit value detection. From the offset and range calibration 1220, a decision can be made whether to use the "slow" pitch speed limiter 1230A for a situation in which the drilling machine 80 is rotating the drill (not labelled) associated therewith or to use the "fast" pitch speed limiter 1230B for a situation in which the drilling machine 80 is pushing the drill (not labelled) associated therewith. Whether rotating or pushing is occurring is determined by the roll sensor 1250 and the rotation detection unit 1260. The rotation detection unit 1260 can provide a signal to the limiter switch 1270 to activate the appropriate one of the "slow" pitch speed limiter 1230A or the "fast" pitch speed limiter 1230B (e.g., connecting the chosen one thereof with the low pass filter 1240). In an embodiment, the "slow" pitch speed limiter 1230A can be more stable but is relatively slow in its response to a change in pitch. As such the "slow" pitch speed limiter 1230A can be best used when the drill is rotating and no sudden changes in pitch are expected. In an embodiment, the "fast" pitch speed limiter 1230B is configured to provide a faster response to any change in pitch, and a faster change in pitch is most likely to occur during a push mode. In an embodiment, when the "slow" pitch speed limiter 1230A and the "fast" pitch speed limiter 1230B are available, both can operate in tandem, with only one of the two resulting signals being sent (e.g., "slow" related signal when rotating or "fast" related signal when pushing) at a given time, based on the operational mode. Only one of the signals is sent/transmitted at a time in that embodiment given limits on data transmission bandwidth.

Figure 6:
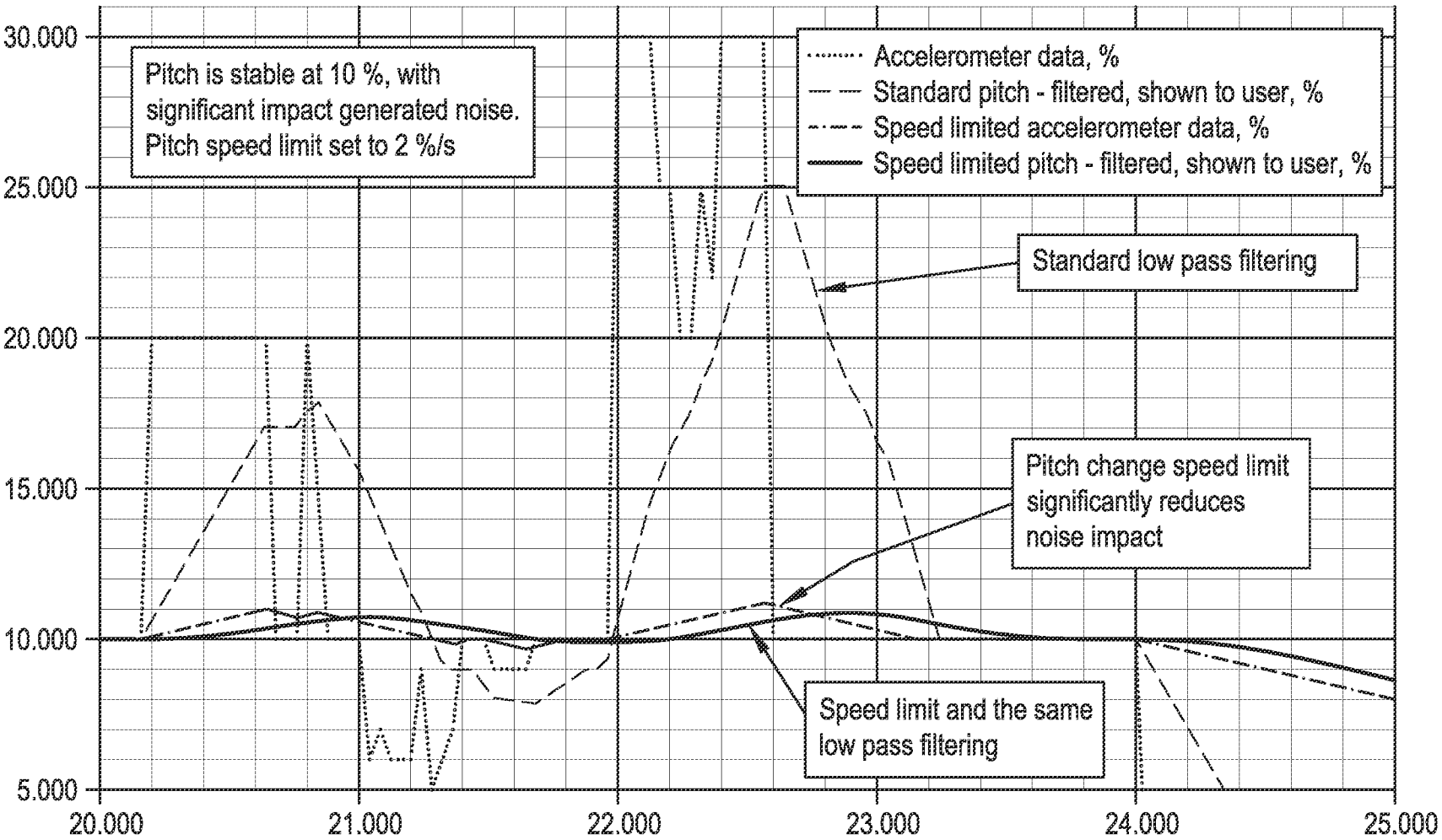
FIG. 6 is an example pitch data plot, in accordance with an embodiment of the present disclosure, including accelerometer data, standard filtered pitch data, speed limited accelerometer data, and filtered speed limited pitch data.

FIG. 6 provides a comparative plot (percent change in pitch versus time, in seconds) of raw accelerometer data, standard pitch data (filtered with a low pass filter), speed limited accelerometer data, and speed-limited and filtered pitch data, the latter displayed to a user. A close-up view (e.g., five second window taken at a generally steady-state pitch), such as chosen for FIG. 6, can be used to accentuate the fluctuations in acceleration and the pronounced effect of employing speed-limiting and/or low-pass filtration. As can be seen, the standard pitch data, the speed limited accelerometer data, and the speed-limited and filtered pitch data can provide, in order, a progressively refined level of data. The speed-limited and filtered pitch data, as the best data set as far as limiting the "noise" from the accelerometer data, can be chosen for output for viewing by a user (e.g., via the display 950) and/or implementation for process control (e.g., by the processor 920).

Figure 7:
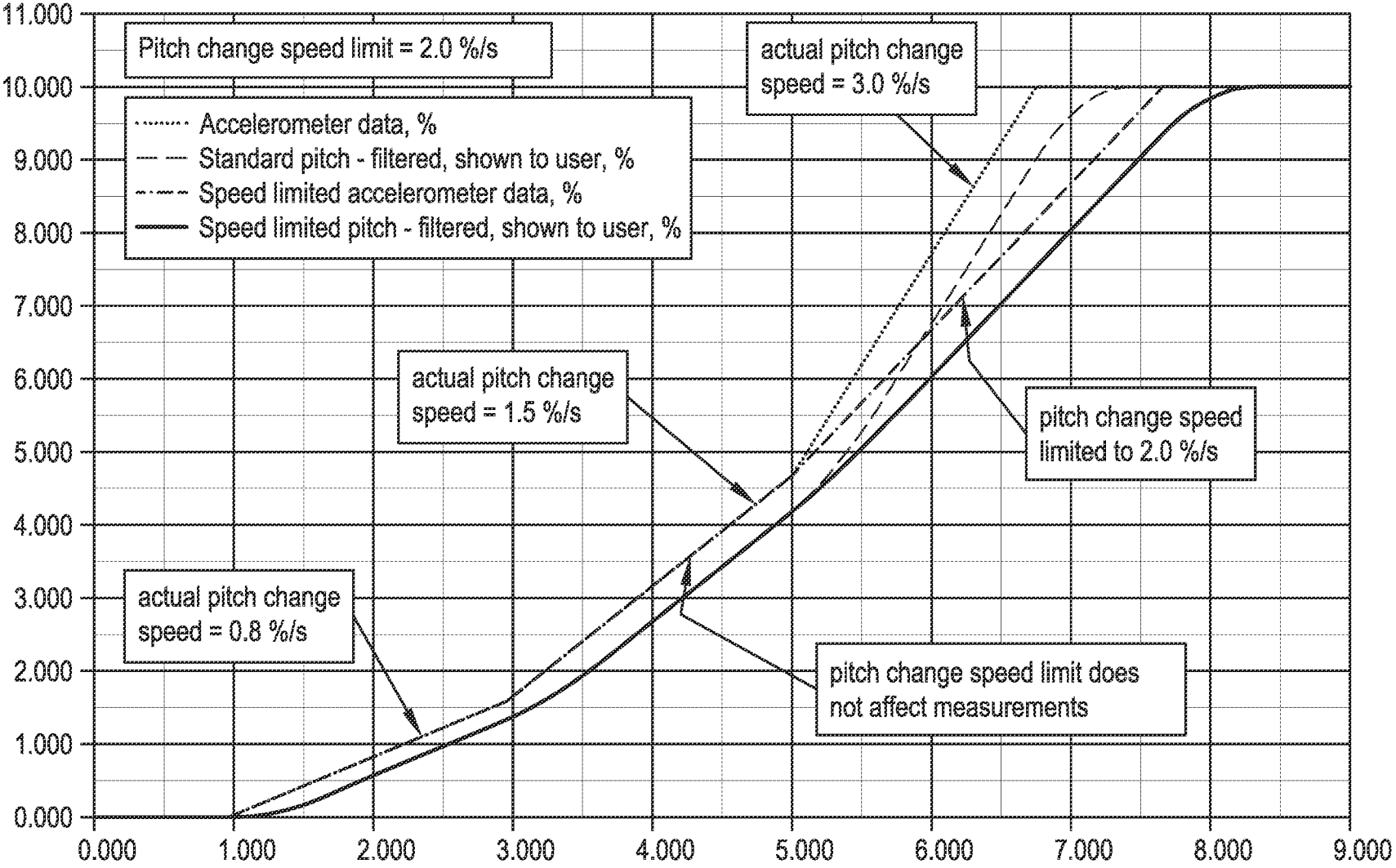
FIG. 7 is an example pitch data plot, in accordance with an embodiment of the present disclosure, including accelerometer data, standard filtered pitch data, speed limited accelerometer data, and filtered speed limited pitch data.

FIG. 7 provides a comparative plot (percent change in pitch versus time, in seconds) of raw accelerometer data, standard pitch data (filtered with a low pass filter), speed limited accelerometer data, and speed-limited and filtered pitch data, with a pitch change limit of 2%/second. FIG. 7 shows a view of the results from a starting position and proceeding to a generally steady state pitch level (e.g., moving to a desired depth and then generally maintaining that depth), resulting in a sloped plot until reaching a near steady state (e.g., after about 8 sec.). As noted in FIG. 7, the implementation of a speed limit does not affect the actual ("raw") pitch change (e.g., accelerometer) measurements. That is, the pitch processing system 1100, 1200 can be expected to first measure a sensed (e.g., "raw") pitch change using an accelerometer 1110, 1210 which can thereafter be processed (e.g., using a speed limit and a low pass filter) to yield a refined pitch change output for use.

Figure 8:
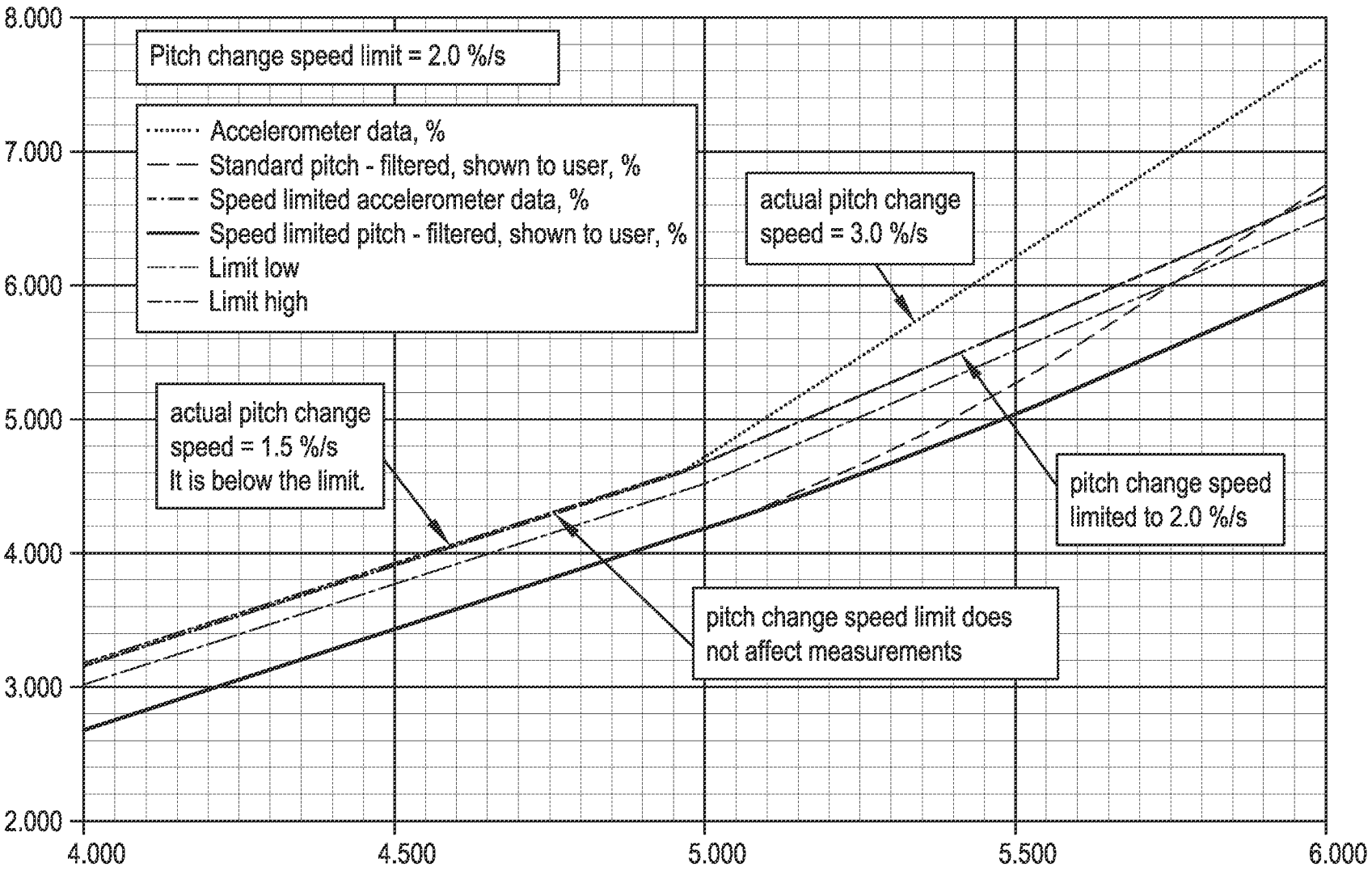
FIG. 8 is an example pitch data plot, derived from the plot shown in FIG. 7, including accelerometer data, standard filtered pitch data, speed limited accelerometer data, and filtered speed limited pitch data, indicating upper and lower limits on the pitch data.

FIG. 8 provides a comparative plot (percent change in pitch versus time, in seconds) of a window from 4-6 seconds derived from the graph of FIG. 7, with FIG. 8 also showing raw accelerometer data, standard pitch data (filtered with a low pass filter), speed limited accelerometer data, and speed-limited and filtered pitch data, with a pitch change limit of 2%/second. Unlike FIG. 7, FIG. 8 further indicates the upper and lower speed limits, as well. Like with FIG. 7, the implementation of a speed limit does not affect the actual ("raw") pitch change (e.g., accelerometer) measurements.

A system 1100, 1200 limiting the rate of change in the pitch can present a hurdle when the transmitter is not below ground. When demonstrating the system 1100, 1200 above ground (e.g., at tradeshows), the transmitter can run into readings that would be impossible underground. For example, the pitch can change from 0 to 40 percent abruptly. Under normal (i.e., below ground), the system 1100, 1200 can limit the change over time, so instead of immediately going to 40, it can climb slowly (e.g., per the chosen limit). Although scenarios like this cannot occur underground without mechanical failure, this slow change above ground can create the perception in customers and potential customers as to this the system 1100, 1200 and its related transmitter being "slow." To solve this, once the system 1100, 1200 detects a large jump in pitch over x % (e.g., 10%) staying over this threshold limit in the same direction over a certain period of time (1-2 seconds) it decides the jump is an actual change in pitch and not created by an object (e.g., an underground obstacle) that created a spike, it can change the pitch change speed window size to allow a faster rate of change. Once pitch change speed goes below the threshold limit of x % (e.g., 10%), it can bring the window size back down and slowly converge on the final pitch position.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A pitch data processing system for a horizontal directional drilling system, the pitch data processing system comprising:

a sonde including an accelerometer, wherein the accelerometer is configured to measure and output a raw pitch signal;

an offset and range calibration unit for receiving and initially processing the raw pitch signal from the sonde, the offset and range calibration unit configured to output a calibrated pitch signal;

a pitch speed limiter for receiving the calibrated pitch signal from the offset and range calibration unit, the pitch speed limiter configured to set at least one of an upper pitch change speed limit or a lower pitch change speed limit, the pitch speed limiter configured to yield a speed-change limited pitch signal; and a filter for receiving the speed-change limited pitch signal from the pitch speed limiter, the filter configured to attenuate the received speed-change limited pitch signal above a selected cutoff frequency of the filter, the filter configured to output a speed-limited and filtered pitch signal for at least one of a display or for controlling operation of the horizontal directional drilling system.

2. The pitch data processing system of claim 1, wherein the sonde is operable as a below-ground unit, and wherein the offset and range calibration unit, the pitch speed limiter, and the filter are incorporated together within an above-ground locator unit.

3. The pitch data processing system of claim 1, wherein the sonde is operable as a below-ground unit, and wherein the offset and range calibration unit, the pitch speed limiter, and the filter are incorporated together within the sonde.

4. The pitch data processing system of claim 1, wherein an above-ground communication unit is configured to wirelessly communicate a maximum pitch change speed to the sonde, the maximum pitch change speed selected by a system user.

5. The pitch data processing system of claim 1, wherein the at least one of the upper pitch change speed limit or the lower pitch change speed limit is chosen based on at least one of a size of the horizontal directional drilling system or a type of drilling job performed.

6. The pitch data processing system of claim 5, wherein the pitch speed limiter is configured to set both an upper pitch change speed limit and a lower pitch change speed limit, and wherein a maximum pitch change speed between the upper pitch change speed limit and the lower pitch change speed limit is selected to be between 5% and 10% per second for a drilling situation tolerant of a greater level of pitch instability.

7. The pitch data processing system of claim 5, wherein the pitch speed limiter is configured to set both an upper pitch change speed limit and a lower pitch change speed limit, and wherein a maximum pitch change speed between the upper pitch change speed limit and the lower pitch change speed limit is selected to be 5% per second or less for a drilling situation dictating a greater level of pitch stability.

8. The pitch data processing system of claim 1, wherein the pitch speed limiter is a first pitch speed limiter configured for use in a situation when the horizontal directional drilling system is in a pushing mode.

9. The pitch data processing system of claim 8, further comprising a second pitch speed limiter configured for use in a situation when the horizontal directional drilling system is in a rotating mode.

10. The pitch data processing system of claim 9, further comprising a roll sensor and a rotation detection unit together configured to determine which of the first pitch speed limiter or the second pitch speed limiter is to be selectably activated.

11. The pitch data processing system of claim 1, wherein the system is configured to determine that a large change in pitch exceeds a threshold limit in the same direction over a chosen amount of time and to then allow a faster rate of pitch change until a pitch change speed drops below the threshold limit.

12. A pitch data processing system for a horizontal directional drilling system, the pitch data processing system comprising:

an offset and range calibration unit for receiving and initially processing the raw pitch signal received from an accelerometer of a sonde, the offset and range calibration unit configured to output a calibrated pitch signal, the offset and range calibration unit disposed within one of an above-ground locator unit or the sonde;

a pitch speed limiter communicatively coupled with the offset and range calibration unit, the pitch speed limiter configured to receive the calibrated pitch signal from the offset and range calibration unit, the pitch speed limiter configured to set at least one of an upper pitch change speed limit or a lower pitch change speed limit, the pitch speed limiter configured to yield a speed-change limited pitch signal; and a filter communicatively coupled with the pitch speed limiter, wherein the filter is configured to receive the speed-change limited pitch signal from the pitch speed limiter, the filter configured to attenuate the received speed-change limited pitch signal above a selected cutoff frequency of the filter, the filter configured to output a speed-limited and filtered pitch signal for at least one of a display or for controlling operation of the horizontal directional drilling system.

13. The pitch data processing system of claim 12, wherein the offset and range calibration unit, the pitch speed limiter, and the filter are incorporated together within one of the above-ground locator unit or the sonde.

14. The pitch data processing system of claim 12, wherein the at least one of the upper pitch change speed limit or the lower pitch change speed limit is chosen based on at least one of a size of the horizontal directional drilling system or a type of drilling job performed.

15. The pitch data processing system of claim 14, wherein the pitch speed limiter is configured to set both an upper pitch change speed limit and a lower pitch change speed limit, and wherein a maximum pitch change speed between the upper pitch change speed limit and the lower pitch change speed limit is selected to be between 5% and 10% per second for a drilling situation tolerant of a greater level of pitch instability.

16. The pitch data processing system of claim 14, wherein the pitch speed limiter is configured to set both an upper pitch change speed limit and a lower pitch change speed limit, and wherein a maximum pitch change speed between the upper pitch change speed limit and the lower pitch change speed limit is selected to be 5% per second or less for a drilling situation dictating a greater level of pitch stability.

17. The pitch data processing system of claim 12, wherein the pitch speed limiter is a first pitch speed limiter configured for use in a situation when the horizontal directional drilling system is in a pushing mode.

18. The pitch data processing system of claim 17, further comprising a second pitch speed limiter configured for use in a situation when the horizontal directional drilling system is in a rotating mode.

19. The pitch data processing system of claim 18, further comprising a roll sensor and a rotation detection unit together configured to determine which of the first pitch speed limiter or the second pitch speed limiter is to be selectably activated.

20. The pitch data processing system of claim 12, wherein the system is configured to determine that a large change in pitch exceeds a threshold limit in the same direction over a chosen amount of time and to then allow a faster rate of pitch change until a pitch change speed drops below the threshold limit.

* * * * *